United States Patent [19]

Imahori et al.

[11] Patent Number: 4,523,542

[45] Date of Patent: Jun. 18, 1985

[54] PAVING APPARATUS FOR A TRAVELLING PATH FOR VEHICLES OF GUIDE RAIL SYSTEM

[75] Inventors: Jumpei Imahori; Yutaka Sugie, both of Kobe, Japan

[73] Assignee: Sumitomo Gomu Kogyo Kabushiki Kaisha, Kobe, Japan

[21] Appl. No.: 462,035

[22] Filed: Jan. 28, 1983

[30] Foreign Application Priority Data

Jan. 29, 1982 [JP] Japan ..... 57-13120

[51] Int. Cl.[3] ..... B05C 11/02

[52] U.S. Cl. ..... 118/663; 118/713; 118/108

[58] Field of Search ..... 118/108, 414, 663, 708, 118/713, 207, 208, 104; 198/500

[56] References Cited

U.S. PATENT DOCUMENTS 2,768,521 10/1956 Milow ..... 118/108

4,134,361 1/1979 Benjamin ..... 118/108 X

FOREIGN PATENT DOCUMENTS 56-22803 3/1981 Japan .

*Primary Examiner*—John P. McIntosh

*Attorney, Agent, or Firm*—Robert E. Burns; Emmanuel J. Lobato; Bruce L. Adams

[57] ABSTRACT

A paving apparatus for rails for a guide rail type vehicle like a suspension type mono-rail in which drive wheels travel on left and right travelling paths and guide wheels travel along a pair of guide rails. The paving apparatus comprises a bogie bridged between a pair of guide rails and travelling along upper edges thereof and a base plate suspended adjustably in height with respect to the bogie, said base plate having a pair of pressing rollers supported on the base plate so as to oppose to respective left and right travelling road surfaces. A spot light from the base plate is irradiated on a marking tape indicative of an execution reference line provided on the guide rail to thereby adjust the height thereof.

16 Claims, 3 Drawing Figures

PAVING APPARATUS FOR A TRAVELLING PATH FOR VEHICLES OF GUIDE RAIL SYSTEM

FIELD AND BACKGROUND OF THE INVENTION

The present invention relates to a paving apparatus, and more specifically, to a road surface paving apparatus for a travelling path for a guide rail system vehicle which travels along guide rails by rubber tires, for example, a travelling path for a suspension type mono-rail.

Vehicles of transportation which travel along guide rails having rubber tires as travelling wheels are represented by mono-rail cars. However, as a means of transportation used witin cities or areas where the distance between stations is relatively short and users are small in number a new transportation system has been recently put to practical use, in which system, one or a few vehicles are made to travel along guide rails. The guide rails for such a mono-rail or new transportation system has its tire travelling surface provided with an anti-skid of tire and pavement finished layer. In the past, the pavement finishing is often carried out manually. However, the guide rails are of the overhead construction. In addition, in the suspension type mono-rails, a section thereof is formed into a box-shape and the tire travelling surface is provided on the box-shaped inner surface, and therefore, work is to be accomplished at a high place several meters from the ground and at a narrow place. Further, it is difficult to finish the pavement surface extremely flatly and uniformly over a long distance while averaging pavement materials of high viscosity such as epoxy resins whose aggregate is silica sand or the like into a small thickness of a few millimeters, resulting in a poor work efficiency. However, as is known, the rugged travelling path leads to a direct vibrating source with respect to the tires, and therefore, the flatness of the travelling road surface is greatly related to the comfortableness of the vehicles of the type as described.

In view of the foregoing, in the past, a paving apparatus for mechanically paving the travelling road surface of such guide rails has been proposed. For example, in Japanese Patent Application No. 54-98265 (Patent Application Laid-Open No. 56-22803) filed by the same assignee as the present application, there is proposed a paving apparatus having a roller which averages pavement material on the travelling road surface of the guide rails. This paving apparatus comprises a bogie provided to be positioned on the travelling road surface, a roller rotatably mounted on the bogie and a motor for rotating and driving the roller, whereby the bogie is moved forward by the rotation of the roller. However, this paving apparatus can pave only one travelling road surface, and since the mono-rail and the rails for the new transportation system as previously mentioned have a pair of left and right travelling road surfaces, it is difficult to obtain the relative flatness of each travelling road surface.

SUMMARY OF THE INVENTION

It is an object of the present invention to provide a paving apparatus for a rail travelling path for a guide rail system vehicle which travels along guide rails.

It is a further object of the present invention to provide a paving apparatus which can flatten the surfaces of left and right travelling paths of guide rails and can very easily obtain the relative flatness of the left and right travelling paths.

In accordance with the present invention, there is provided a paving apparatus for paving pavement materials on left and right travelling paths of rails for a guide rail system vehicle in which driving wheels travel on the left and right travelling paths and guide wheels travel along a pair of guide rails, the apparatus comprising a bogie which is bridged between a pair of guide rails and travels along the upper edges thereof, a base plate suspended from said bogie so that the height thereof may be adjusted, a pair of paving means supported on the base plate in opposed relation to each of the left and right travelling surfaces, level detecting means comprising a means indicative of an execution reference line provided on the guide rail and a means in cooperation with said indicating means to detect the height of the base plate, whereby the pavement materials are simultaneously paved on the respective travelling road surfaces by means of the pair of left and right paving means while the bogie moves along the upper edges of the guide rails.

In accordance with a preferred embodiment of the present invention, the paving means comprises a pressing roller, which is driven by a driving source independently of the travelling of the bogie. Further, the means for indicating an execution reference line comprises a marking tape. The detecting means comprises a light source, wherein a spot light from the detecting means is irradiated on the marking tape to adjust the height of the base plate, that is, the height of the paving means thereby controlling the level of pavement material.

The paving apparatus according to the present invention is characterized in that guide rails for guide wheels of a travelling vehicle are utilized without modification, wherein a pair of left and right paving rollers are provided on the base suspended from a bogie which travels along the guide rails, and the pavement materials are simultaneously averaged on the left and right travelling road surfaces by the roller during travelling of the bogie. Accordingly, even if the travelling road surfaces to be paved have rugged portions, these road surfaces may be paved flatly and both the left and right sides thereof may be paved simultaneously, and therefore, the relative flatness of the travelling road surfaces may also be obtained.

DESCRIPTION OF THE PREFERRED EMBODIMENTS

Figure 1:
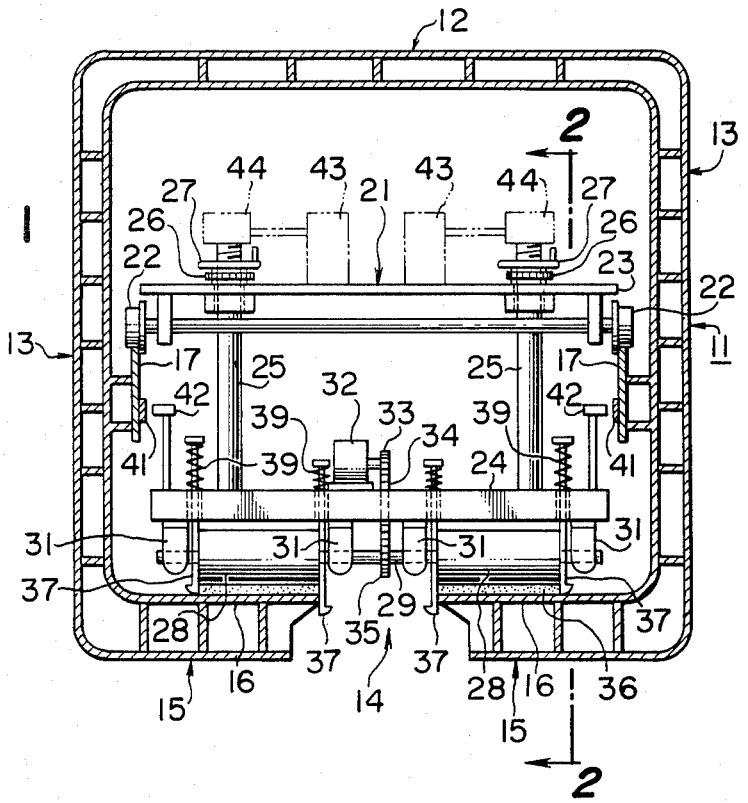
FIG. 1 is a partly cutaway front view showing an embodiment in which a paving apparatus of the present is applied to a suspension type mono-rail.

One embodiment of the present invention will now be described, in which case, the paving apparatus is applied to a suspension type mono-rail. In FIG. 1, this mono-rail is generally indicated at reference number 11. This mono-rail 11 has substantially a box-shape in section constituted by an upper portion 12, both side portions 13, 13, and a bottom portion 15 having a longitudinally extending opening 14 in the central portion thereof, the mono-rail being formed of steel iron. The upper surface 16 of the bottom portion 15, on both sides of the opening 14, serves as a travelling road surface for travelling wheels (not shown) mounted on a bogie truck of a mono-rail car. Guide rails 17 with which guide wheels (not shown) of the bogie truck come into contact are provided on the inner surfaces on both sides of the mono-rail 11. The paving apparatus generally indicated at reference numeral 21 is constructed such that pavement materials are executed uniformly and flatly on the upper surface 16, that is, the travelling road surface, of the bottom portion 15 while travelling on the upper edges of the guide rails 17 within the mono-rail 11.

Figure 2:
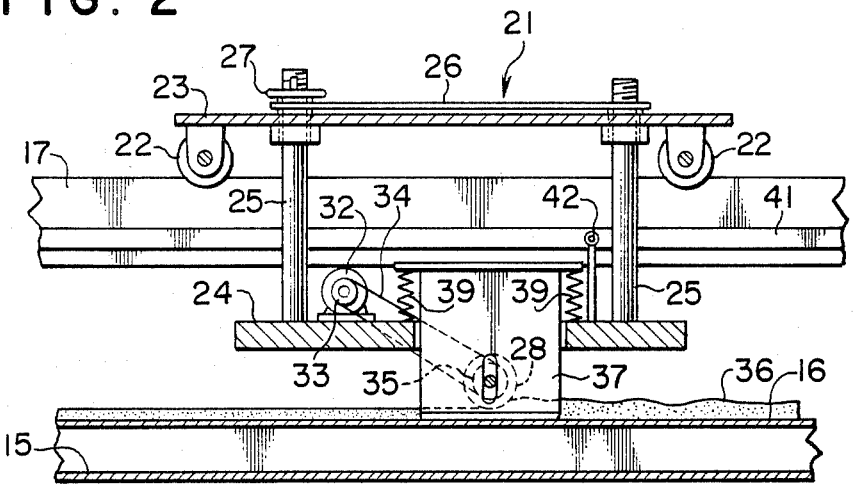
FIG. 2 is a side view taken along line 2—2 of FIG. 1.

The paving apparatus 21 has four wheels 22 which travel along the upper edges of the guide rails 17, 17, and is provided with a bogie or carriage 23 bridged between the guide rails for travelling. A base plate 24 provided with a paving mechanism is suspended adjustably in height from the bogie 23. In this embodiment, the base plate 24 is suspended from the bogie 23 through four height adjusting threaded shafts 25 provided at the front, rear, left and right corners. Those of said four height adjusting threaded shafts 25 arranged in a relation of front and rear as viewed from the advancing direction of the bogie 23 are connected to each other by means of a chain 26 as shown in FIG. 2, and an operating handle 27 is mounted on one height adjusting threaded shaft 25 of each set. On the base plate 24 is provided a paving mechanism having a pair of left and right paving pressing rollers 28, 28 of the same diameter corresponding in length to the width of the travelling road surfaces 16, 16 of the mono-rail 11.

Figure 3:
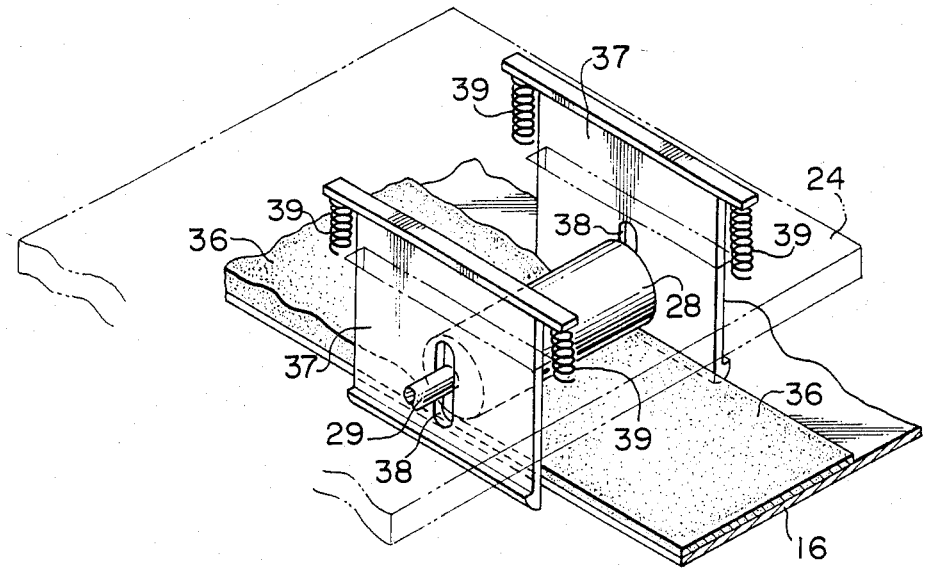
FIG. 3 is a perspective view in enlarged scale of a paving roller portion.

The rollers 28, 28 each have the same driving shaft 29 and are supported by well known bearings through the driving shaft 29 so that the lower edges thereof are in the same horizontal plane. Mounted on the driving shaft 29 are a drive gear 33 of a motor 32 installed on the base plate 24 and a driven gear 35 connected and driven by a chain 34. On both sides of each roller 28 are provided plate-like control plates 37, 37 for controlling the width of pavement of pavement material 36 rolled by the roller 28. A portion of the control plate 37 through which the drive shaft 29 extends is formed with a vertically extending elongated slit hole 38 which is slidable with respect to the drive shaft, as shown in FIG. 3. The lower end of each control plate 37 is formed into a sled-like configuration as shown in FIGS. 1 and 3. Each control plate 37 is held movably up and down by the base plate 24 so as to be biased downwardly by means of a spring 39. In this embodiment, two control plates 37 are arranged to be projected downwardly from the travelling road surfaces 16, 16 along the end edge of the opening 14 as shown.

The paving apparatus 21 further comprises a level detecting means for maintaining constant the thickness of pavement material 36 on the travelling road surfaces 16, 16. This level detecting means has a marking tape 41 provided as an execution reference line on the guide rail 17 and detecting means 42 provided on both sides of the base plate 24 in opposed relation to the tape 41. This detecting means 42 comprises a lamp which illuminates the tape 41. The handle 27 is operated so that the irradiated light from said lamp may scan, for example, the upper edge of the tape 41 to adjust the height of the base plate 24 through the height adjusting threaded shafts 25. With this, the thickness of pavement material 36 rolled by the roller 28 may be maintained constant.

Next, the operation of the present embodiment will be described. The bogie 23 of the paving apparatus 21 has a motor or the like mounted thereon though not shown and is designed to be self-travelled rightwards in FIG. 2. First, as the preparatory stage, the marking tapes 41, 41 as execution reference lines are adhered to side surfaces of the guide rails 17, 17 using adhesives or the like, and pavement material 36 is prescattered coarsely on the travelling road surfaces 16, 16 of the mono-rail. Preferably, pavement material 36 is epoxy mortar whose aggregate is for example silica sand or the like. Scattering of pavement material can be done by a hopper bogie (not shown) in which a hopper is mounted on a bogie similar to the above-described bogie 23.

The pavement material 36 thus coarsely scattered is finished by the paving apparatus 21. That is, the operating handle 27 is operated so that the spot light from the detecting means 42, 42 may be irradiated, for example, on the upper edge of the tapes 41, 41 to thereby adjust the height of the base plate 24 with respect to the bogie 22. With this, the height of the roller 28 supported on the base plate 24 is adjusted. Next, the bogie 23 is self-travelled rightwards in FIG. 2 along the guide rail 17 while rotating the pair of left and right rollers 28 through the drive shaft 29 by the motor 32. In this case, the rollers 28 are rotated in the same direction as the advancing direction of the bogie 23, that is, clockwise in FIG. 2, and the peripheral speed thereof is preset to be two to six times faster than the advancing speed of the bogie 23. Thus, as the bogie 23 travels, the prescattered pavement material 36 is extremely flatly rolled with high density and with a given thickness while receiving a shearing force by the roller 28. In this paving apparatus 21, the control plates 37, 37 are provided on both sides of each roller 28, and therefore, the side edges of the pavement layer is finely finished without use of an executing frame. Since this control plate 37 is held movably up and down on the base plate 24 in the state where the control plate is biased downwardly by the spring 39, the control plate is slidably moved while always contacting with the side of the travelling road surface 16 even if the height of the base plate 24 and roller 28 is varied, and can control satisfactorily the side edge, that is, the width of the pavement layer irrespective of the pavement thickness by the roller 28. Along the curved portions of the mono-rail 11, either the left or right operating handle 27 is operated to tilt the base plate in a lateral direction in FIG. 1 to thereby form a suitable cant angle in the pavement layer rolled on the travelling road surfaces 16, 16.

While in the above-described embodiment, the thickness of the pavement material 36 is manually adjusted by operating the operating handle 27, it should be noted that the detecting means 42 can be formed from a photoreflective sensor in which a light emitting portion and a photo-detector are integrally formed, or a solid image sensor using a diode array or CCD (Charge Coupling Type Element), which are well known sensors. In this case, as shown in the phantom outlines in FIG. 1, a servo-motor 43 is mounted on the bogie 23, a gear box 44 is provided on the height adjusting threaded shafts 25, said gear box is mechanically coupled to the servo-motor, and forward and reverse rotations of the servo-motor 43 are controlled by a signal from the detecting means 42.

Alternatively, a known hopper is mounted on the bogie 23 itself, and the pavement material is rolled by the roller 28 while feeding the material onto the travelling road surface 16 from the hopper. The pavement is not limited to the roller 28 but various known screens, for example, such as a screen with a vibrator can be used. Of course, the bogie 23 can be of the tractive type or hand-operated type.

What is claimed is:

1. A paving apparatus for paving pavement materials on left and right travelling paths of a rail for a guiding system vehicle of the type having driving wheels which travel on surfaces of the left and right travelling paths and guide wheels which travel along a pair of guide rails, the apparatus comprising: a bogie for travelling along the upper edges of the pair of guide rails, a base plate adjustably suspended from said bogie so that the height thereof may be adjusted, a pair of paving means supported on the base plate so as to oppose the surfaces of the left and right travelling paths, and level detecting means for detecting the height of the base plate comprising means indicative of an execution reference line provided on at least one guide rail and means cooperating with said indicating means to detect the height of the base plate, whereby the pavement materials can be simultaneously paved on the respective travelling road surfaces by the pair of left and right paving means while the bogie moves along the upper edges of the guide rails.

2. A paving apparatus according to claim 1, wherein said base plate has at least one extending threaded shaft, one end of which is mounted on said base plate and the other end extends through said bogie, and an operating handle threadedly engaged with said threaded shaft projected on said bogie, whereby the height of said base plate with respect to said bogie may be adjusted by rotation of said operating handle.

3. A paving apparatus according to claim 1, wherein each said paving means comprises a pressing roller which rotates at a peripheral speed faster than the travelling speed of said bogie.

4. A paving apparatus according to claim 1, wherein each said paving means comprises a pressing roller and a motor for driving said pressing roller so that said roller may be rotated at a peripheral speed faster than the travelling speed of said bogie.

5. A paving apparatus according to claim 1, wherein each said paving means comprises a pressing roller which rotates at a peripheral speed faster than the travelling speed of said bogie and a control plate supported movably up and down on both ends in an axial direction of said pressing roller to control the width of pavement.

6. A paving apparatus according to claim 1, wherein said indicating means comprises a marking tape provided on said guide rail and said cooperating means comprises a light source for irradiating a spot light on said marking tape.

7. A paving apparatus according to claim 1, wherein said indicating means comprises a light reflecting member provided on said guide rail to set an execution reference line and said cooperating means comprises a photo-detector for irradiating light on said light reflecting member and for receiving the reflected light.

8. A paving apparatus for paving the travelling paths of a rail system of the type having a pair of spaced apart travelling paths located below a pair of spaced apart guide rails, the paving apparatus comprising: a movable carriage having wheels for riding along the guide rails of the rail system; a base plate; means adjustably suspending the base plate from the carriage for enabling the vertical height of the base plate to be adjusted relative to the carriage; detecting means for detecting the height of the base plate relative to the carriage as the carriage rides along the guide rails of the rail system; and paving means supported by the base plate for simultaneously paving the surfaces of the pair of travelling paths of the rail system with pavement material as the carriage rides along the guide rails of the rail system.

9. A paving apparatus as claimed in claim 8; wherein the paving means comprises a pair of rotatable pressing rollers mounted to undergo rotation in opposed relation with respect to respective ones of the pair of travelling paths of the rail system for pressing the pavement material onto the pair of travelling surfaces.

10. A paving apparatus as claimed in claim 9; wherein the paving means includes means for rotationally driving the pressing rollers at a peripheral speed faster than the speed at which the carriage rides along the guide rails.

11. A paving apparatus as claimed in claim 9; wherein the means adjustably suspending the base plate includes means for enabling tilting of the base plate in a direction transverse to the lengthwise direction of the rail system to thereby tilt the pressing rollers.

12. A paving apparatus as claimed in claim 9; wherein the paving means includes movable control plates mounted to undergo vertical movement at opposite ends of each pressing roller for controlling the width of the pavement material, and biasing means for biasing the control plates downwardly.

13. A paving apparatus as claimed in claim 9; wherein the detecting means comprises a lengthwise extending marking along at least one of the guide rails of the rail system, and means mounted on the base plate for irradiating a light spot on the marking as the carriage rides along the guide rails.

14. A paving apparatus as claimed in claim 9; wherein the detecting means comprises a light-reflecting marking extending lengthwise along at least one of the guide rails, and a photo-detector for irradiating light onto the light-reflecting marking and for receiving reflected light reflected by the light-reflecting marking.

15. A paving apparatus as claimed in claim 8; wherein the detecting means comprises a lengthwise extending marking along at least one of the guide rails of the rail system, and means mounted on the base plate for irradiating a light spot on the marking as the carriage rides along the guide rails.

16. A paving apparatus as claimed in claim 8; wherein the detecting means comprises a light-reflecting marking extending lengthwise along at least one of the guide rails, and a photo-detector for irradiating light onto the light-reflecting marking and for receiving reflected light reflected by the light-reflecting marking.

* * * * *